United States Patent [19]

Haider et al.

[11] Patent Number: 4,567,614

[45] Date of Patent: Feb. 4, 1986

[54] SEATING OR SLEEP FURNITURE

[76] Inventors: Eduard F. Haider, Dechantsees 23, D-8591 Pullenreuth; Siegfried Purner, Adam-Krafft-Strasse 6, D-8590 Marktredwitz, both of Fed. Rep. of Germany

[21] Appl. No.: 521,329

[22] Filed: Aug. 8, 1983

[51] Int. Cl.[4] ..... A47D 9/00; A45F 3/22

[52] U.S. Cl. ..... 5/124; 5/103; 5/207; 297/276

[58] Field of Search ..... 5/101, 109, 103, 104, 5/124–127, 204, 207–210, 244; 297/273, 276, 281

[56] References Cited

U.S. PATENT DOCUMENTS

| | | | |
|---|---|---|---|
| 118,919 | 9/1871 | Foote | 5/210 |
| 585,206 | 6/1897 | Hoffman | 5/124 |
| 1,444,726 | 2/1923 | Broyles | 5/210 |
| 2,377,464 | 6/1945 | Tucker | 5/244 |
| 2,768,916 | 9/1955 | Borochoff | 5/124 |
| 2,814,052 | 11/1957 | Kaiser | 5/210 |
| 3,125,767 | 3/1964 | Griggs et al. | 5/109 |
| 3,439,363 | 4/1969 | Meeks | 5/103 |
| 4,419,778 | 12/1983 | Griffith | 5/244 |

*Primary Examiner*—Kenneth J. Dorner
*Assistant Examiner*—Michael F. Trettel
*Attorney, Agent, or Firm*—Scully, Scott, Murphy & Presser

[57] ABSTRACT

A seating or sleep furniture piece having a frame in which an upper portion is pendularly suspended from a lower stationary portion supported on the floor. The upper portion supports the seating or sleep support surface for a user and allows for comfortable pendular and sleep-inducing or restful movements. The pendulum lengths may be adjusted to vary the pendulating effects, or the frame portions latched together to prevent relative movements when desired by a user.

11 Claims, 8 Drawing Figures

FIG. 1
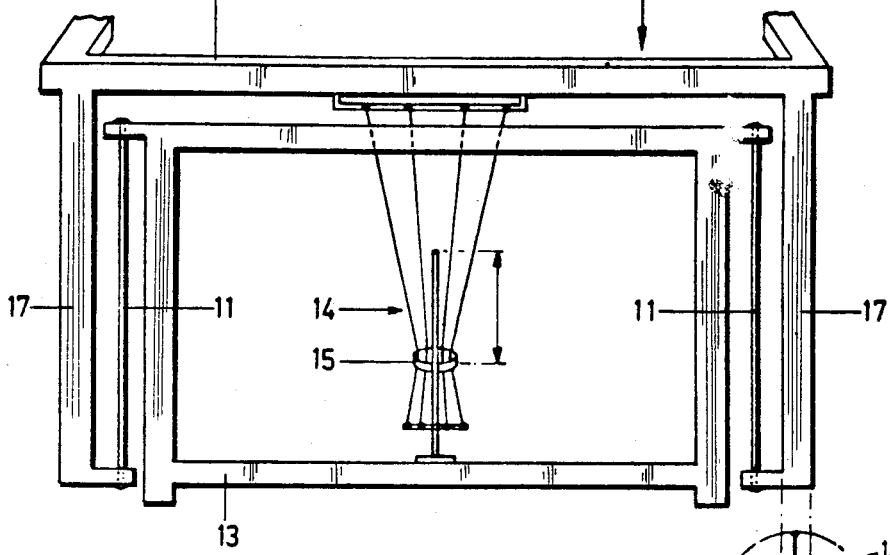
FIG. 1a
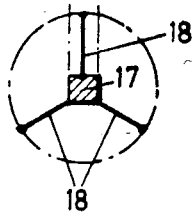
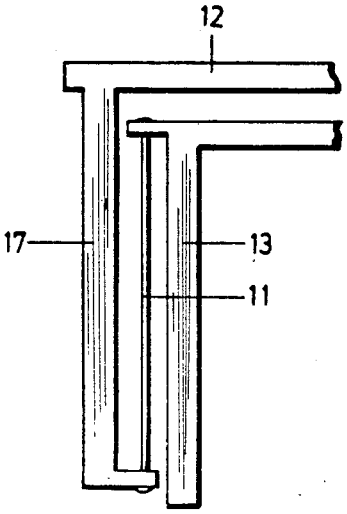
FIG. 2
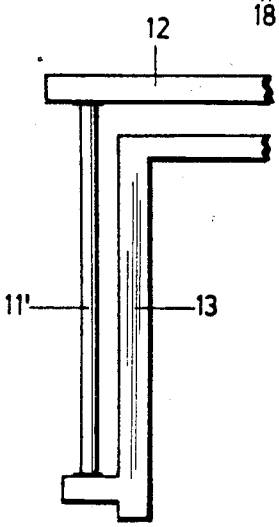
FIG. 3

SEATING OR SLEEP FURNITURE

BACKGROUND OF THE INVENTION

1. Field of the Invention

The present invention relates to a seating or a sleep furniture piece.

2. Discussion of the Prior Art

Heretofore, numerous attempts have been made for replacing the currently widely employed static seating and sleep furniture by means of dynamic furniture. Thus, rocking chairs are already known which, in contrast with the usual chairs, evidence a dynamic component. Quite in conformance therewith, this is also valid with regard to perambulators which, because of their dynamic components, have been found by infants to be particularly pleasurable and sleep-inducing. More recently, there has appeared the waterbed on the market as representative of the modern type of a dynamic bed.

However, the waterbed is subject to significant disadvantages in that it requires relatively much space, will always react to movements, is extremely heavy and quite expensive; as well as there can be expected not insignificant damages due to any spilling of the water. Moreover, the waterbed does not allow for any continual upward and downward movements, and does not afford any constantly uniform-remaining horizontal support surface.

SUMMARY OF THE INVENTION

Accordingly, it is an object of the present invention to provide a dynamic seating or sleep furniture piece which, with a relatively low weight and at a relatively low price, imparts to the user a movement in three coordinate directions.

The foregoing object pursuant to the invention is obtained in that an upper portion of the furniture piece supporting the seating or sleeping surface, and which is arranged immediately above a lower portion supported on the floor, is pendularly suspended from the lower portion through the intermediary of arms arranged therebelow and extending downwardly, through a plurality of pendulums.

The foregoing construction has the significant advantage that, besides the relatively small spatial requirement and the relatively low price, at a smallest body movement of the resting or sleeping person there is afforded a highest measure of self-motivated dynamic. Hereby, there is avoided any kind of generation of noise.

This is of quite considerable significance to a person attempting to sleep, inasmuch as just during the night hours at a low noise level in the surroundings even small noises are found to be extremely disturbing.

BRIEF DESCRIPTION THE THE DRAWINGS

Reference may now be had to the following detailed description of exemplary embodiments of the invention, taken in conjunction with the accompanying drawings; in which:

FIG. 1 illustrates an end view of a dynamically-supported bed frame;

FIG. 1*a* shows an alternate arrangement for holding outside vertical elements of the bedframe.

FIG. 2 illustrates a detail of the suspension of the bed frame through a pendulum suspension;

FIG. 3 is a detail of the suspension of the bed frame through a pendulum support stand;

DETAILED DESCRIPTION

Figure 4:
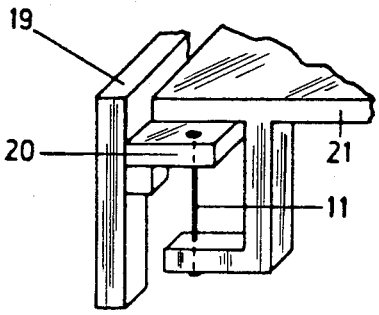
FIG. 4 is a modified embodiment adapted for use in a usual bed frame.

FIG. 1 illustrates an ordinary frame 10 which, however, due to its pendulum suspension, distinguishes itself from the usual frames. In lieu of the usual foot of base, the foot is split herein in the longitudinal direction and the respective parts are interconnected through a pendulum 11. This renders it possible to set the upper portion 12 of the bed frame into a universally-directional pendulating motion relative to te lower, stationary portion 13. The configuration of the two portions 12 and 13 of the bed frame need merely be so selected that a mutual contacting between the upper and lower portions of the bed frame will not occur during the pendular movements, since this would be considered as disturbing.

Here, for example, a suitable cushioning through soft rubber can serve for the quite extensive reduction of such shocks, in the event that the constructively provided pendular movements are exceeded at any one time. Found to be quite satisfactory has been a so-called "counter-pendulum" 14 with pendulum lengths which deviate with respect to the actual pendulum. In accordance with the available free pendulum length of the counter-pendulum 14, the pendular movements of the upper portion 12 of the bed frame are more or less restricted in their displacement with respect to the lower portion 13 without hereby causing any kind of shocks. The braking of pendular movement is effected at increasing displacements at an increasing counterforce and is completely free of sliding movement. With a capability of adjustments of the effective pendulum length of the counter-pendulum 14 the user himself can adjust the desired effects. With shortening effective lengths of the counter-pendulum 14, the pendular movements of the upper portion 12 of the bed frame are increasingly reduced and namely, as mentioned, without any sliding effect.

The adjustability of the effective pendulum length can be effected, for instance, by means of a vertically adjustable retainer 15, for example, in the shape of a ring encompassing the individual strands of the counter-pendulum 14. This can be carried out in steps as well as gradually. Moreover, the arrangement of the pendulums relative to each other, the pendulum lengths and the weight of the user exert an influence over the pendulum characteristics.

Although it is basically possible to configure the counter-pendulum 14 as a single strand, in many instances it has been found to be as being advantageous to construct the counter-pendulum 14 from a plurality of strands since, thereby, through differing configuration of the basic surface for the contact points of the individual strands of the counter-pendulum 14, there can be achieved different effects in the respective directions. Whereas during the use of a square basic surface none of the directions is preferred, for a rectangular or oval basic surface the effects of the counter-pendulum can be different in the individual directions. In the direction of the lengthier sides of the rectangle or, respectively the oval, there is obtained practically the effect of a longer counter-pendulum 14, whereas in the direction of the narrower side of the rectangle, or respectively in the direction of the smaller diameter of the oval, there is obtained the effect of a shorter counter-pendulum 14. Thus, also the pendulum effects in one or the other direction can be individually adjusted by the user. In the action of the counter-pendulum, naturally the longitudinal elasticity of the individual strands of the counter pendulum 14 has a considerable significance.

Figure 5:
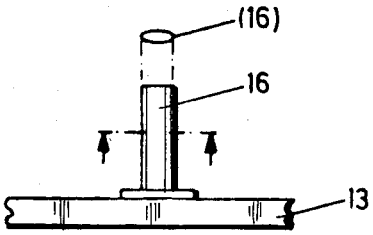
FIG. 5 illustrates a specialized construction of the counter-pendulum in the configuration of a flexural rod having an oval cross-section.
Figure 6:
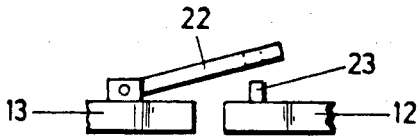
FIG. 6 illustrates the construction of a pendulum latch.

A corresponding effect can also be achieved with the aid of a flexural rod 16 which has either a circular, or also an oval cross-section, and which then will also exhibit a directionally-dependent behavior. With reference to FIG. 5, flexural rod 16 is connected to lower portion 13 and extends upwardly therefrom. As upper portion 12 vibrates, energy therefrom is transmitted to flexural rod 16, causing that rod to vibrate, and dampening vibrating movement of the upper portion of the furniture piece.

It would also be possible to retain the vertical elements 17 of the upper portion 12 of the bed frame which lead to the pendulum suspension thereabout in rubber strands 18, shown in FIG. 1*a* through which it is also possible to contemplate a restriction over the pendulum movements. However, due to the hereby encountered expansions in the rubber strands as a result of the elastic deformations, energy is used, in effect, there occurs a damping effect. Similar effects are obtained when the vertical element 17 of the upper portion 12 of the bed frame is encompassed by a foam rubber cushion which, in turn, is fixedly supported in place.

Figure 7:
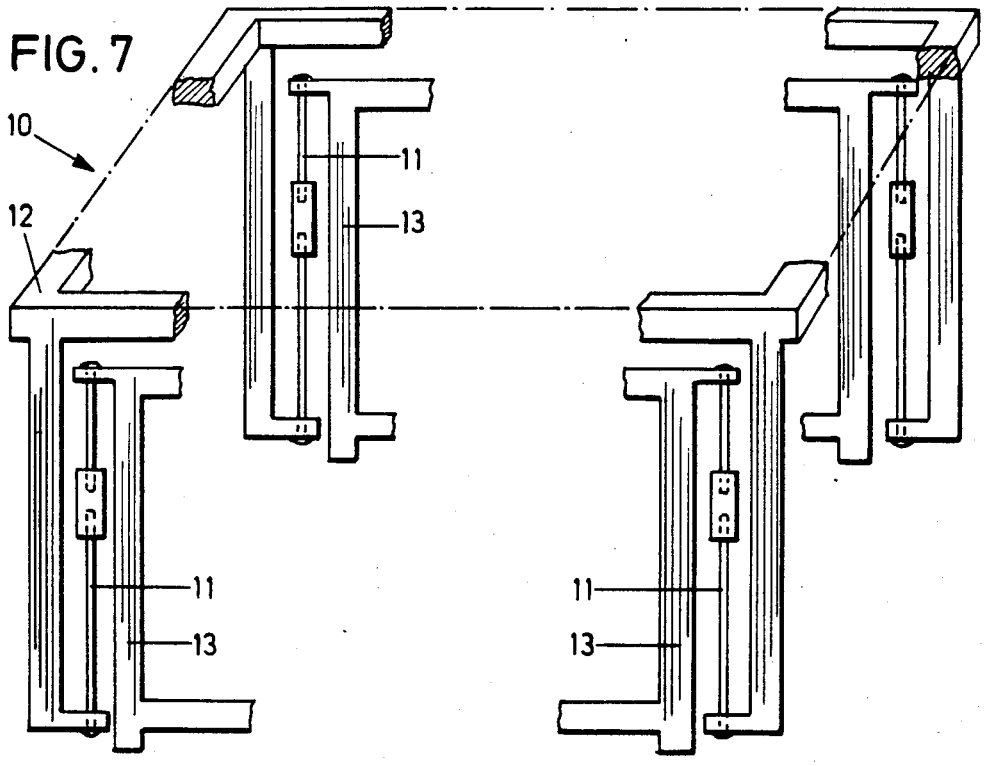
FIG. 7 is a partial orthoginal view of a furniture piece having an upper portion supported by four, adjustable length pendulums.
Figure 8:
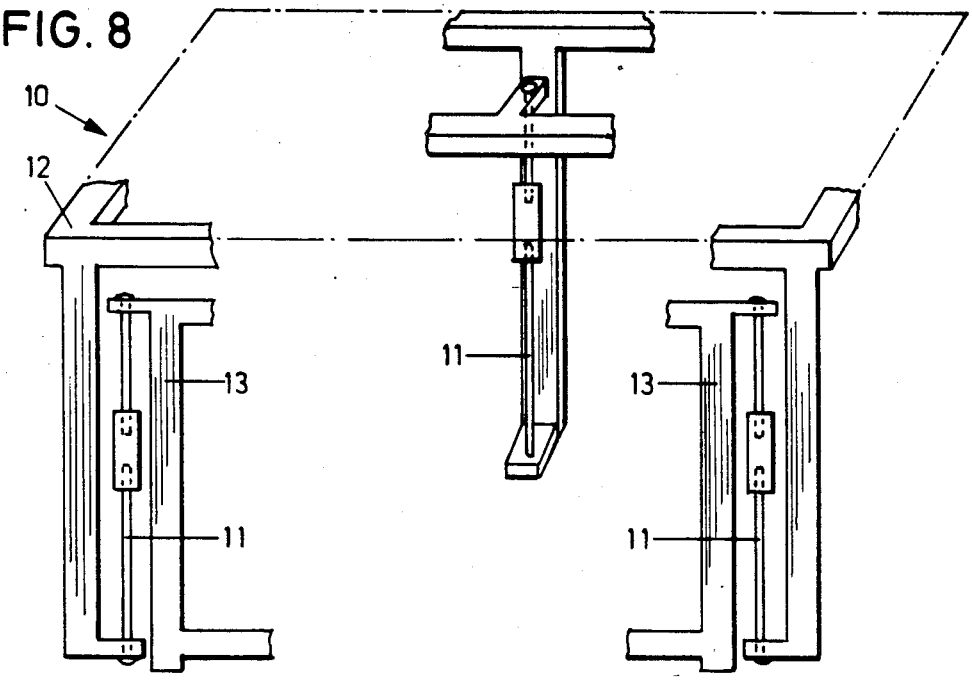
FIG. 8 is a partial orthogonal view of a furniture piece having an upper portion supported by three, adjustable length pendulums.

FIGS. 7 and 8 show portions of a furniture piece in accordance with this invention wherein upper portions 12 are supported, respectively, by four and three adjustable length pendulums 11.

As is illustrated in FIG. 3, in lieu of a hanging pendulum 11 there can also be employed a pendulum support 11', which then provides for a pendular connection between the upper portion 12 of the bed frame and the stationary lower portion 13 of the bed frame. Also for such an arrangement can there be employed the previously mentioned counter-pendulum 14.

As can be ascertained from FIG. 4 of the drawings, even a usual type of bed fram 19 can be rendered dynamic without significant remodeling. For this purpose, in lieu of the usual spring insert there is introduced a flat frame 20 which assumes the task of the lower stationary portion 13 of the bed frame, and on which there is suspended for free swinging the movable upper portion 21, which corresponds to the movable portion of the bed frame, through the aid of a pendulum 11. The action thereof is as described hereinabove.

Insofar as the user, for any reason and at predetermined times, does not desire the possible pendular movement, the two mutually movable portions 12 and 13, or respectively 20 and 21, can be arrested with respect to each other by an emcompassable or displaceable latching loop 22 and a cooperating pin 23, or the like, so that the dynamic bed will then only provide the effect of a static bed.

Although, hereinabove, the effects have been basically described with regard to a seating or sleep furniture piece, the system can also find application in the support of highly-sensitive machines or apparatuses, as well as for chair and table combinations.

In a completely corresponding manner as described previously with regard to the latching, individually pendulating systems can also be coupled to each other. There can also be provided a motorized drive which provides the pendular impulses.

What is claimed is:

1. In a furniture piece including an upper portion and a lower portion supportable on the floor; and a support surface pendularly suspended; the improvement comprising: said upper portion being arranged immediately above said lower portion and supporting said support surface, and upper portion including arms arranged therebelow and extending downwardly projecting, a plurality of pendulums pendularly suspending the upperportion from said lower portion, and a counter-pendulum having an effective length deviating from the effective length of the pendulums for influencing the pendular movement of the upper portion.

2. Furniture piece as claimed in claim 1, wherein the effective length of the counter-pendulum is adjustable to a plurality of separate and distinct effective pendulum lengths.

3. Furniture piece as claimed in claim 1, wherein the effective length of the counter-pendulum is gradually adjustable.

4. Furniture piece as claimed in claim 2, wherein the counter-pendulum comprises a plurality of strands having a longitudinal elasticity and prestressing, and a ring holding said strands together in a bundle.

5. Furniture piece as claimed in claim 4, wherein the ring is rectangular in cross-section.

6. Furniture piece as claimed in claim 4, wherein the ring is square in cross-section.

7. Furniture piece as claimed in claim 4, wherein the ring is oval in cross-section.

8. In a furniture piece including an upper portion and a lower portion supportable on the floor; and a support surface pendularly suspended; the improvement comprising: said upper portion being arranged immediately above said lower portion and supporting said support surface, said upper portion including arms arranged therebelow and extending downwardly, a plurality of pendulums engaging said arms to pendularly suspend the upper portion from said lower portion for oscillating movement in three coordinate directions highly responsive to movement of a person on the support surface, and a flexural rod connected to the lower portion of the furniture piece and extending upward therefrom to dampen the pendular movement of the upper portion of the furniture piece, said rod extending substantially parallel to the pendulums.

9. Furniture piece as claimed in claim 8, wherein the flexural rod has a circular cross-section.

10. Furniture piece as claimed in claim 8, wherein the flexural rod has an oval cross-section.

11. In a furniture piece including an upper portion and a lower portion supportable on the floor; and a support surface pendularly suspended; improvement comprising: said upper portion being arranged immediately above said portion and supporting said support surface, said upper portion including arms arranged therebelow and extending downwardly, a plurality of pendulums engaging said arms to pendularly suspend the uper portion from said lower portion for oscillating movement in three coordinate directions highly responsive to movement of a person on the support surface, and a pendulum latch to arrest selectively relative pendular movement between the upper and lower portions of the furniture piece, wherein the pendulum latch includes an encompassing loop member connected to a selected one of the upper and lower portions of the furniture piece, and a pin connected to the other one of the upper and lower portions to cooperate selectively with the encompassing loop member to latch together the upper and lower portions of the furniture piece.

* * * * *